US010107225B2

(12) United States Patent
Kitazume et al.

(10) Patent No.: US 10,107,225 B2
(45) Date of Patent: Oct. 23, 2018

(54) FUEL INJECTION CONTROL DEVICE

(71) Applicant: TOYOTA JIDOSHA KABUSHIKI KAISHA, Toyota-shi, Aichi-ken (JP)

(72) Inventors: Akinori Kitazume, Nagoya (JP); Masanao Idogawa, Toyota (JP); Hiroyuki Mizuno, Toyota (JP)

(73) Assignee: TOYOTA JIDOSHA KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/884,541

(22) Filed: Jan. 31, 2018

(65) Prior Publication Data

US 2018/0230928 A1 Aug. 16, 2018

(30) Foreign Application Priority Data

Feb. 14, 2017 (JP) ..... 2017-025464

(51) Int. Cl.

| | |
|---|---|
| ***F02B 1/00*** | (2006.01) |
| ***F02D 41/30*** | (2006.01) |
| ***F02D 41/06*** | (2006.01) |
| ***F02D 41/04*** | (2006.01) |

(52) U.S. Cl.

CPC ..... *F02D 41/3094* (2013.01); *F02D 41/047* (2013.01); *F02D 41/064* (2013.01); *F02D 41/068* (2013.01); *F02D 2200/021* (2013.01)

(58) Field of Classification Search

CPC .... F02D 41/3094; F02D 41/06; F02D 41/061; F02D 41/062; F02D 41/064; F02D 2013/0292; F02D 35/023; F02D 35/024; F02D 35/025; F02D 35/026

USPC ..... 123/429, 431, 434, 435; 701/101, 701/103–105, 113

See application file for complete search history.

(56) References Cited

U.S. PATENT DOCUMENTS

| | | | | |
|---|---|---|---|---|
| 9,890,734 | B2 * | 2/2018 | Kawabe | F02M 69/046 |
| 2015/0233317 | A1 * | 8/2015 | Kawabe | F02D 41/3094 123/491 |
| 2016/0169148 | A1 * | 6/2016 | Yokoi | F02D 41/0062 123/299 |
| 2018/0087466 | A1 * | 3/2018 | Bromberg | F01N 3/035 |

FOREIGN PATENT DOCUMENTS

| | | | |
|---|---|---|---|
| JP | 2006-258049 | A | 9/2006 |
| JP | 2012-117472 | A | 6/2012 |
| JP | 2014-034882 | A | 2/2014 |

* cited by examiner

*Primary Examiner* — John Kwon
(74) *Attorney, Agent, or Firm* — Oliff PLC

(57) ABSTRACT

A cold-time fuel increasing section calculates, as increase correction values for a required injection amount, an increase-after-startup correction value, which attenuates with an increment of the number of times of combustion carried out after startup of the internal combustion engine, and a basic warmup increase correction value, which attenuates with an increase in a temperature of coolant in the internal combustion engine. The cold-time fuel increasing section calculates the increase correction values such that the increase-after-startup correction value when the port injection mode is selected is greater than the increase-after-startup correction value when the single direct injection mode is selected, and that the basic warmup increase correction value when the port injection mode is selected is less than the basic warmup increase correction value when the single direct injection mode is selected.

7 Claims, 5 Drawing Sheets

FUEL INJECTION CONTROL DEVICE

BACKGROUND OF THE INVENTION

The present invention relates to a fuel injection control device configured to switch an injection mode between direct injection and port injection.

During the cold time of an internal combustion engine, a failure in fuel vaporization easily occurs and fuel easily adheres to a wall surface. Consequently, some of injected fuel does not make any contribution to combustion. For this reason, it is common to increase a fuel injection amount during such cold time of an internal combustion engine. Meanwhile, as described in Japanese Laid-Open Patent Publication No. 2012-117472, an internal combustion engine has been known that is provided with two different types of fuel injection valves including a port injection valve, which injects fuel into an intake port, and a direct injection valve, which injects fuel into a combustion chamber. In the internal combustion engine, the injection mode is switched such that the injection ratio of the direct injection and the port injection is varied.

The occurrence condition of a failure in fuel vaporization or adhesion of fuel to a wall surface during the cold time depends on the area to which the fuel is injected. For this reason, if both the fuel injection amount in direct injection and the fuel injection amount in port injection are increased in the same manner during the cold time, the amount of fuel that contributes to the actual combustion may be excessive or insufficient.

SUMMARY OF THE INVENTION

An objective of the present invention is to provide a fuel injection control device capable of appropriately performing correction to increase a fuel injection amount during the cold startup of an internal combustion engine the injection mode of which is switched between direct injection and port injection.

To achieve the foregoing objective and in accordance with one aspect of the present invention, a fuel injection control device is provided that includes a cold-time fuel increasing section, which calculates an increase-after-startup correction value and a basic warmup increase correction value for the required injection amount. The cold-time fuel increasing section calculates the increase-after-startup correction value, which attenuates with an increment of the number of times of combustion carried out after startup of the internal combustion engine, and calculates the basic warmup increase correction value, which attenuates with an increase in a temperature of coolant in the internal combustion engine. The cold-time fuel increasing section executes (A) calculation of the increase-after-startup correction value such that the increase-after-startup correction value when the port injection mode is selected is greater than the increase-after-startup correction value when the single direct injection mode is selected, and/or (B) calculation of the basic warmup increase correction value such that the basic warmup increase correction value when the single direct injection mode is selected is greater than the basic warmup increase correction value when the port injection mode is selected.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A fuel injection control device 30 according to one embodiment of the present invention will now be described with reference to FIGS. 1 to 10.

Figure 1:
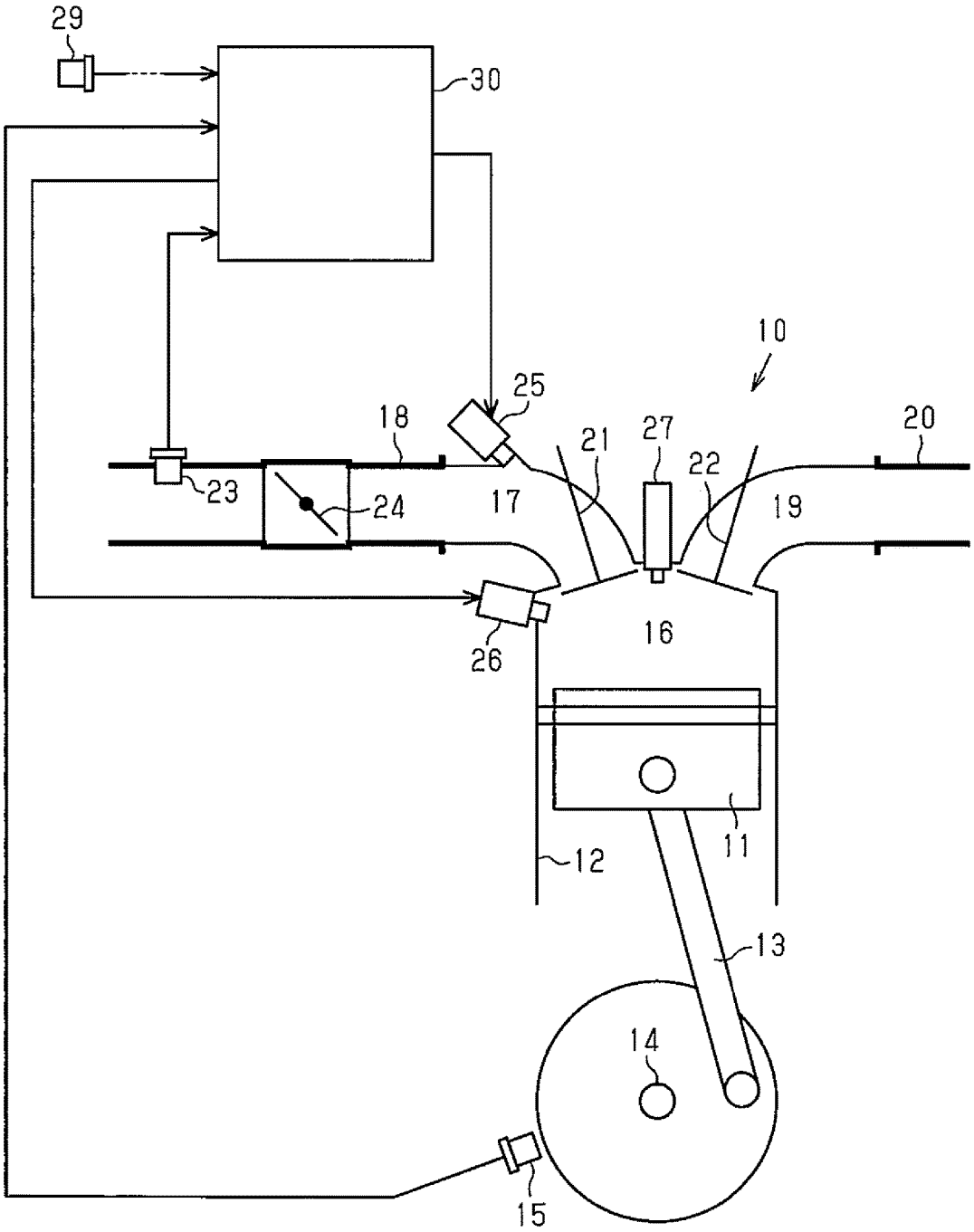
FIG. 1 is a diagram schematically illustrating the configuration of an internal combustion engine to which a fuel injection control device according to one embodiment of the present invention is applied.

First, a description is given of the configuration of an internal combustion engine 10 to which the fuel injection control device 30 of the present embodiment is applied with reference to FIG. 1.

The internal combustion engine 10 includes a cylinder 12 that accommodates a piston 11 in a reciprocatable manner. The piston 11 is connected to a crankshaft 14 via a connecting rod 13. The connection structure therebetween functions as a crank mechanism of converting reciprocating motion of the piston 11 to rotating motion of the crankshaft 14. Further, a crank angle sensor 15 that outputs a pulse signal (a crank angle signal CR) according to rotation of the crankshaft 14 is provided near the crankshaft 14 in the internal combustion engine 10.

Inside the cylinder 12, a combustion chamber 16 is defined by the piston 11. An intake pipe 18 is connected to the combustion chamber 16 via an intake port 17. An exhaust pipe 20 is also connected to the combustion chamber 16 via an exhaust port 19. An intake valve 21 that is opened and closed in conjunction with rotation of the crankshaft 14, is provided at a connection part of the intake port 17 to the combustion chamber 16. Also, an exhaust valve 22 that is opened and closed in conjunction with rotation of the crankshaft 14, is provided at a connection part of the exhaust port 19 to the combustion chamber 16.

The intake pipe 18 includes an air flowmeter 23 that detects the flow rate of intake air (an intake air amount GA) being sent to the combustion chamber 16 through the intake pipe 18, and includes a throttle valve 24, which is a valve that adjusts the amount of intake air. A port injection valve 25 that injects fuel into intake air passing through the intake port 17 is set on the intake port 17. A direct injection valve 26 that injects fuel into the combustion chamber 16 and an ignition plug 27 that ignites fuel through spark discharge are mounted on the combustion chamber 16.

The fuel injection control device 30 is configured as an electronic control unit that controls the port injection valve 25 and the direct injection valve 26 in the internal combustion engine 10. A detection signal of the aforementioned intake air amount GA and the crank angle signal CR are inputted to the fuel injection control device 30. A detection signal from a water temperature sensor 29 that detects the temperature (a coolant temperature THW) of coolant of the internal combustion engine 10 is also inputted to the fuel injection control device 30. The fuel injection control device 30 calculates the speed (an engine speed NE) of the internal combustion engine 10 based on the crank angle signal CR. Further, the fuel injection control device 30 calculates an engine load rate KL based on the engine speed NE and the intake air amount GA. The engine load rate KL represents a cylinder inflow air amount which is an amount of air flowing into the combustion chamber 16, and is a value expressed as a ratio to the cylinder inflow air amount at a full-load time of the internal combustion engine 10.

A description is given below of fuel injection control (cold time control) to be performed by the fuel injection control device 30 during the cold startup of the internal combustion engine 10. The cold startup refers to the time period from the time point when startup of the internal combustion engine 10 is started while the coolant temperature THW is not higher than a specified temperature, to the time point when the coolant temperature THW reaches the specified temperature.

The fuel injection control device 30 switches, according to the operation state of the internal combustion engine 10, the mode (an injection mode MODE) of fuel injection to be carried out by the port injection valve 25 and the direct injection valve 26. In the fuel injection control device 30, each type of the injection mode MODE is represented by use of an array formed of two elements. The first element for representing the type of the injection mode MODE is the number of times of injection (port injection) carried out by the port injection valve 25 in the injection mode. The second element is the number of times fuel injection (direct injection) carried out by the direct injection valve 26 in the injection mode. Hereinafter, the first element and the second element of the array for the injection mode MODE are referred to as MODE [0] and MODE [1], respectively (MODE={MODE [0], MODE [1]}).

During the cold startup of the internal combustion engine 10, a port injection mode, a distributed injection mode, a single direct injection mode, or a multiple injection mode is used. In the port injection mode, a required injection amount QINJ of fuel is injected in a single port injection. In the distributed injection mode, the required injection amount QINJ of fuel is divided and injected in a single port injection and one to three direct injections. In the single direct injection mode, the required injection amount QINJ of fuel is injected in a single direct injection. In the multiple direct injection mode, the required injection amount QINJ of fuel is divided and injected in multiple direct injections. Examples of the multiple direct injection mode include a mode in which two direct injections are carried out and a mode in which three direct injections are carried. Hereinafter, the former mode is referred to as a two-time direct injection mode, and the latter is referred to as a three-time direct injection mode.

The ratio of the injection amount in port injection (port injection amount) to the required injection amount QINJ is referred to as a port injection ratio KPI. Table 1 shows the values of MODE [0], MODE [1], and KPI in the injection modes MODE. As shown in Table 1, the value of the port injection ratio KPI is 1 in the port injection mode, and is 0 in the single direct injection mode, the two-time direct injection mode, and the three-time direct injection mode. In the distributed injection mode, the value of the port injection ratio KPI changes between 0 and 1 according to the distribution ratio of fuel injection amounts in port injection and direct injection.

TABLE 1

| Injection Mode | MODE [0] | MODE [1] | KPI |
|---|---|---|---|
| Port Injection Mode | 1 | 0 | 1 |
| Distributed Injection Mode | 1 | 1-3 | 0-1 |
| Single Direct Injection Mode | 0 | 1 | 0 |
| Two-Time Direct Injection Mode | 0 | 2 | 0 |
| Three-Time Direct Injection Mode | 0 | 3 | 0 |

Figure 2:
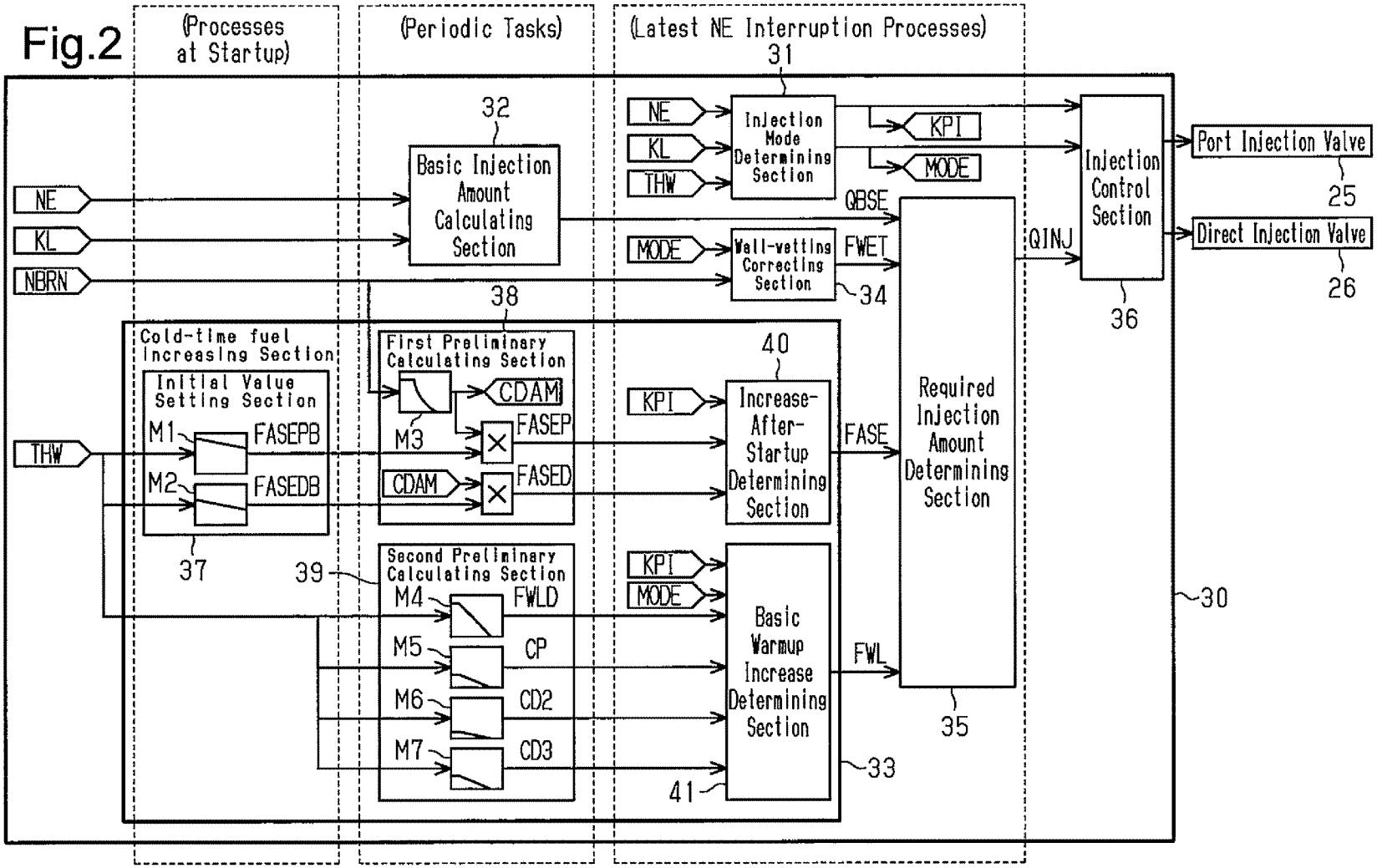
FIG. 2 is a block diagram of the controlling structure for injection control to be performed during startup by the fuel injection control device.

FIG. 2 illustrates the controlling structure for fuel injection control to be performed by the fuel injection control device 30 during the cold startup. As illustrated in FIG. 2, the fuel injection control device 30 includes, as the control structure, an injection mode determining section 31, a basic injection amount calculating section 32, a cold-time fuel increasing section 33, a wall-wetting correcting section 34, a required injection amount determining section 35, and an injection control section 36.

The engine speed NE, the engine load rate KL, and the coolant temperature THW are inputted to the injection mode determining section 31. Based on these, the injection mode determining section 31 selects the injection mode MODE to be executed by the internal combustion engine 10. When the distributed injection mode is selected, the injection mode determining section 31 further calculates the port injection ratio KPI based on the engine speed NE, the engine load rate KL, and the coolant temperature THW. In accordance with the result of such selection and calculation, the injection mode determining section 31 outputs the injection mode MODE and the port injection ratio KPI.

The engine speed NE and the engine load rate KL are inputted to the basic injection amount calculating section 32. Based on these, the basic injection amount calculating section 32 calculates and outputs a basic injection amount QBSE. The basic injection amount QBSE calculated here represents an amount of fuel for combustion in the combustion chamber 16.

The cold-time fuel increasing section 33 calculates, as correction values for performing correction to increase a fuel injection amount, which is to be increased during the cold startup of the internal combustion engine 10, an increase-after-startup correction value FASE and a basic warmup increase correction value FWL, and outputs these values. Calculation of the increase-after-startup correction value FASE and the basic warmup increase correction value FWL executed by the cold-time fuel increasing section 33 is described in detail later.

The wall-wetting correcting section 34 calculates and outputs a wall-wetting correction value FWET which is a correction value for correcting the amount of fuel injection carried out immediately after switching of the injection mode. Calculation of the wall-wetting correction value FWET to be executed by the wall-wetting correcting section 34 is described in detail later.

The basic injection amount QBSE, the wall-wetting correction value FWET, the increase-after-startup correction value FASE, and the basic warmup increase correction value FWL are inputted to the required injection amount determining section 35. Based on these, the required injection amount determining section 35 calculates and outputs the required injection amount QINJ. The required injection amount QINJ is calculated so as to satisfy the relationship below.

$$QINJ \leftarrow QBSE \times (1+FWET+FASE+FWL) \quad \text{[Expression 1]}$$

The injection mode MODE, the port injection ratio KPI, and the required injection amount QINJ are inputted to the injection control section 36. Based on these, the injection control section 36 sets the port injection amount and the direct injection amount. That is, when the port injection mode is selected, the port injection amount is set to the required injection amount QINJ whereas the direct injection amount is set to 0. When the single direct injection mode is selected, the port injection amount is set to 0, whereas the direct injection amount is set to the required injection amount QINJ. When the distributed injection mode is selected, the port injection amount is set to the product obtained by multiplying the required injection amount QINJ by the port injection ratio KPI whereas the direct injection amount (the total amount of the direct injections in the case where two or more direct injections are carried out) is set to the difference obtained by subtracting the port injection amount from the required injection amount. When the multiple direct injection mode is selected, the port injection amount is set to 0, whereas the injection amount for each of two or three direct injections is set based on the required injection amount QINJ. When fuel injection is carried out in the multiple direct injection mode, the combustion is improved so that, in terms of injection of the same amount of fuel, the torque generated by the internal combustion engine 10 is larger than that generated in the other injection modes. For this reason, in the multiple direct injection mode, the injection amount for each direct injection is set such that the total injection amount during the two or three direct injections is set to a value obtained by applying steady decrease correction by a specified amount to the required injection amount QINJ. The injection control section 36 controls the port injection valve 25 and the direct injection valve 26 such that the set injection amount of fuel is injected.

As a periodic task to be repeatedly executed at specified time intervals, calculation of the basic injection amount QBSE is executed by the basic injection amount calculating section 32. On the other hand, as latest NE interruption processes to be executed at a specified crank angle before the intake top dead center, calculation of the wall-wetting correction value FWET is executed by the wall-wetting correcting section 34 and calculation of the required injection amount QINJ is executed by the required injection amount determining section 35.

As periodic tasks to be executed at a cycle shorter than the calculation cycle of the basic injection amount QBSE, determination of the injection mode MODE and calculation of the port injection ratio KPI are executed by the injection mode determining section 31. Further, the injection mode to be finally executed is determined from the value of the injection mode MODE at the time of the latest NE interruption processes. Accordingly, the value of the injection mode MODE may be changed during a time period after completion of calculation of the basic injection amount QBSE to the determination of the injection mode to be executed. In this way, the basic injection amount QBSE is calculated when the injection mode has not been determined. In contrast, the injection mode is determined before the latest NE interruption processes are executed.

Next, a detailed description is given of calculation of the increase-after-startup correction value FASE to be executed by the cold-time fuel increasing section 33. Some of fuel injected from the port injection valve 25 adheres to the wall surface of the intake port 17 or the wall surface of the intake valve 21. Some of fuel injected from the direct injection valve 26 adheres to the wall surface of the cylinder 12 or the wall surface of the piston 11. During the cold startup, the temperatures of these wall surfaces are low and a large amount of fuel adheres to the wall surfaces. A correction value for increasing the fuel injection amount while predicting the amount of fuel that adheres to the wall surfaces and thereby does not make any contribution to combustion, is an increase-after-startup correction value FASE. The cold-time fuel increasing section 33 includes an initial value setting section 37, a first preliminary calculating section 38, and an increase-after-startup determining section 40, as a lower control structure for calculating the increase-after-startup correction value FASE.

The initial value setting section 37 executes, as a startup process to be executed only one time at the start of the startup of the internal combustion engine 10, calculation of initial values FASEPB, FASEDB of a first reference value FASEP and a second reference value EASED for use in the calculation of the increase-after-startup correction value FASE based on the coolant temperature THW at the start of the startup. The initial values FASEPB, FASEDB are calculated with reference to calculation maps M1, M2 stored in advance in the fuel injection control device 30, respectively. The initial value FASEPB is calculated as a value equivalent to the ratio of the amount of fuel that adheres to the wall surface with respect to the amount of fuel that is injected in the port injection mode at the coolant temperature THW at the start of the startup. The initial value FASEDB is calculated as a value equivalent to the ratio of the amount of fuel that adheres to the wall surface with respect to the amount of fuel that is injected in the direct injection at the coolant temperature THW at the start of the startup.

Figure 3:
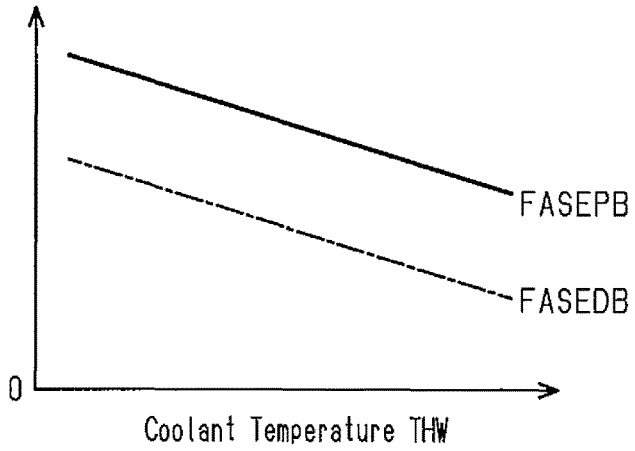
FIG. 3 is a graph showing the relationship between a coolant temperature during startup and respective initial values of a first reference value and a second reference value set by an initial value setting section provided in the fuel injection control device.

FIG. 3 shows the relationship between the coolant temperature THW and the initial values FASEPB, FASEDB in the calculation map Ml and the calculation map M2. Both the initial values FASEPB, FASEDB become greater as the coolant temperature THW becomes lower. This reflects that, when the coolant temperature THW becomes lower, the wall surface temperatures in the intake port 17 and the cylinder 12 also become lower so that the amount of injected fuel that adheres to the wall surfaces becomes larger. In addition, the initial value FASEPB in the calculation map M1 is greater than the initial value FASEDB in the calculation map M2 at the same coolant temperature THW. This reflects the condition where the amount of injected fuel that adheres to the wall surfaces in the port injection is larger than that in the direct injection.

The first preliminary calculating section 38 calculates a first reference value FASEP and a second reference value FASED based on the initial values FASEPB, FASEDB set by the initial value setting section 37 at the start of the startup of the internal combustion engine 10 and based on the number (the number of times of combustion NBRN) of times of combustion after startup of the internal combustion engine 10. The first preliminary calculating section 38 executes, as a periodic task synchronized with the calculation of the basic injection amount QBSE, calculation of the first reference value FASEP and the second reference value FASED. The first reference value FASEP and the second reference value FASED are calculated before determination of the injection mode.

In the above calculation, the first preliminary calculating section 38 first obtains an attenuation coefficient CDAM based on the number of times of combustion NBRN, by reference to the calculation map M3 stored in advance in the fuel injection control device 30. The first preliminary calculating section 38 calculates, as the first reference value FASEP, the product obtained by multiplying the initial value FASEPB by the attenuation coefficient CDAM, and calculates, as the second reference value FASED, the product obtained by multiplying the initial value FASEDB by the attenuation coefficient CDAM.

Figure 4:
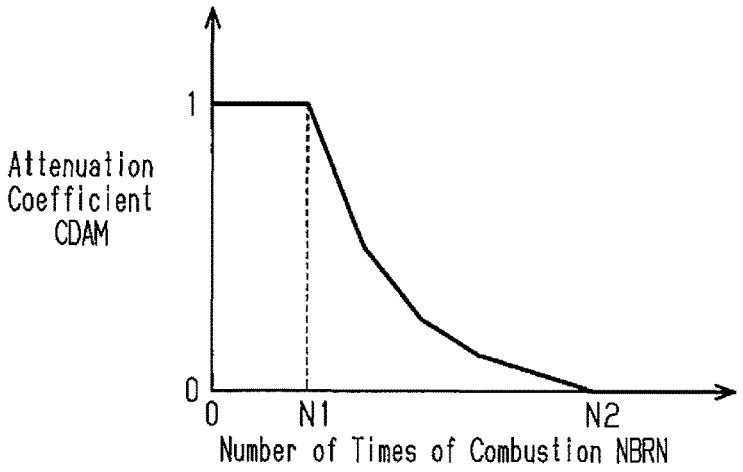
FIG. 4 is a graph showing the relationship between the number of times of combustion after startup of the engine and an attenuation coefficient to be used for calculation of the first reference value and the second reference value by a first preliminary calculating section provided in the fuel injection control device.

FIG. 4 shows the relationship between the number of times of combustion NBRN and the attenuation coefficient CDAM in the calculation map M3. In the case where the number of times of combustion NBRN is incremented from 0, the attenuation coefficient CDAM is kept to 1 until the number of times of combustion NBRN reaches a specified number N1. As the number of times of combustion NBRN is further incremented from the number N1, the attenuation coefficient CDAM attenuates. When the number of times of combustion NBRN reaches a specified number N2, the attenuation coefficient CDAM becomes 0. Thereafter, the attenuation coefficient CDAM is kept to 0.

Both the first reference value FASEP and the second reference value FASED, which are calculated as the products respectively obtained by multiplying the initial values FASEPB, FASEDB by the attenuation coefficient CDAM, are values that attenuate according to the increment of the number of times of combustion NBRN. Until the first reference value FASEP becomes 0 as the number of times of combustion NBRN reaches the number N2, the first reference value FASEP is kept greater than the second reference value FASED.

As described above, during the cold startup, the amount of fuel for combustion is smaller than the amount of injected fuel because the injected fuel adheres to the wall surfaces. The difference between the amount of fuel for combustion and the amount of injected fuel is referred to as a wall-surface adhesion deficiency amount. Each time injection is carried out, new fuel adheres to the wall surfaces. Consequently, the amount of fuel adhering to the wall surfaces (the amount of adhesion to the wall surfaces) increases until a certain time point after the startup of the internal combustion engine 10. However, some of the fuel adhering to the wall surfaces is volatilized, and is burned in the combustion chamber 16. As the amount of adhesion to wall surfaces is larger, the amount of fuel volatilized from the wall surfaces (the amount of volatilized fuel) in one combustion cycle is larger. Therefore, when the number of combustion cycles carried out after the startup of the internal combustion engine 10 exceeds a certain level, the wall-surface adhesion deficiency amount of fuel is decreased, and eventually, equilibrium between the amount of new fuel that adheres to the wall surfaces through injection and the amount of volatilized fuel is achieved so that the wall-surface adhesion deficiency amount of fuel becomes 0. This is reflection of the above attenuation in the first reference value FASEP and the second reference value FASED according to the number of times of combustion NBRN.

The first reference value FASEP represents the increase-after-startup correction value FASE when it is assumed that the port injection mode is selected. The second reference value FASED represents the increase-after-startup correction value FASE when it is assumed that the single direct injection mode is selected. The amount of adhesion to the wall surfaces immediately after the start of cold startup of the internal combustion engine 10 in the port injection mode is larger than that in the single direct injection mode. The first reference value FASEP is calculated to be a value greater than the second reference value FASED, as described above. This reflects the condition where the amount of adhesion to the wall surfaces immediately after the start of cold startup in the port injection mode is larger than that in the single direct injection mode.

Meanwhile, the increase-after-startup determining section 40 calculates the increase-after-startup correction value FASE to be outputted to the required injection amount determining section 35, based on the first reference value FASEP and the second reference value FASED calculated by the first preliminary calculating section 38 and based on the port injection ratio KPI calculated by the injection mode determining section 31. The increase-after-startup determining section 40 executes calculation of the increase-after-startup correction value FASE as a latest NE interruption process, after the injection mode determining section 31 determines the injection mode MODE. The increase-after-startup correction value FASE is calculated so as to satisfy the expression below with respect to the first reference value FASEP, the second reference value FASED, and the port injection ratio KPI.

$$FASE \leftarrow FASEP \times KPI + FASED \times (1 - KPI) \quad \text{[Expression 2]}$$

Figure 5:
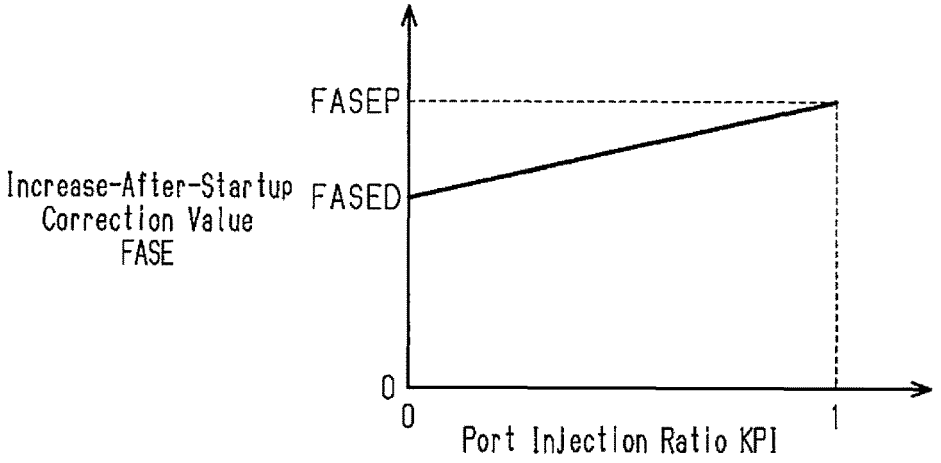
FIG. 5 is a graph showing the relationship between a port injection ratio and an increase-after-startup correction value calculated by an increase-after-startup determining section provided in the fuel injection control device.

FIG. 5 shows the relationship between the port injection ratio KPI and the increase-after-startup correction value FASE. In the port injection mode in which the port injection ratio KPI is 1, the increase-after-startup correction value FASE is equal to the first reference value FASEP calculated by the first preliminary calculating section 38. In contrast, in the single direct injection mode and the multiple direct injection mode in which the port injection ratio KPI is 0, the increase-after-startup correction value FASE is equal to the second reference value FASED calculated by the first preliminary calculating section 38. In the distributed injection mode in which the port injection ratio KPI is set to a value from 0 to 1, when the port injection ratio KPI is changed from 1 to 0, the first reference value FASEP is changed to the second reference value FASED.

Next, a detailed description is given of calculation of the basic warmup increase correction value FWL executed by the cold-time fuel increasing section 33. During the cold startup of the internal combustion engine 10, the temperature in the combustion chamber 16 is low and fuel is less likely to vaporize. Thus, some of injected fuel does not sufficiently vaporize and remains unburned. A correction value for increasing the fuel injection amount while predicting the amount of fuel that does not make any contribution to combustion due to a failure in vaporization is the basic warmup increase correction value FWL. The cold-time fuel increasing section 33 includes, as a lower control structure for calculation of the basic warmup increase correction value FWL, a second preliminary calculating section 39 and a basic warmup increase determining section 41.

The second preliminary calculating section 39 calculates a third reference value FWLD, a first correction value CP, a second correction value CD2, and a third correction value CD3 based on the coolant temperature THW. The second preliminary calculating section 39 executes the calculation as a periodic task in synchronization with the calculation of the basic injection amount QBSE. Thus, the third reference value FWLD, the first correction value CP, the second correction value CD2, and the third correction value CD3 are calculated prior to determination of the injection mode. The third reference value FWLD, the first correction value CP, the second correction value CD2, and the third correction value CD3 are calculated by reference to calculation maps M4, M5, M6, M7, respectively, stored in advance in the fuel injection control device 30.

The third reference value FWLD is calculated as a value equivalent to a rate (a vaporization failure rate) of which the amount of fuel does not make any contribution to combustion due to a vaporization failure, with respect to the amount of fuel injected when fuel injection is carried out in the single direct injection mode. The first correction value CP is calculated as a value equivalent to a difference obtained by subtracting the vaporization failure rate in the port injection mode from the vaporization failure rate in the single direct injection mode. The second correction value CD2 is calculated as a value equivalent to a difference obtained by subtracting the vaporization failure rate in the two-time direct injection mode from the vaporization failure rate in the single direct injection mode. The third correction value CD3 is calculated as a value equivalent to a difference obtained by subtracting the vaporization failure rate in the three-time direct injection mode from the vaporization failure rate in the single direct injection mode.

The third reference value FWLD represents the basic warmup increase correction value FWL when it is assumed that the single direct injection mode is selected. The difference obtained by subtracting the first correction value CP from the third reference value FWLD represents the basic warmup increase correction value FWL when it is assumed that the port injection mode is selected. The difference obtained by subtracting the second correction value CD2 from the third reference value FWLD represents the basic warmup increase correction value FWL when it is assumed that the two-time direct injection mode is selected. The difference obtained by subtracting the third correction value CD3 from the third reference value FWLD represents the basic warmup increase correction value FWL when it is assumed that the three-time direct injection mode is selected.

The second preliminary calculating section 39 does not calculate any value directly corresponding to the basic warmup increase correction values FWL for cases where the port injection mode, the two-time direct injection mode, and the three-time direct injection mode are respectively selected. However, at the time point when the third reference value FWLD and the first correction value CP are calculated, the basic warmup increase correction value FWL for the case where the port injection mode is selected has been already determined. At the time point when the third reference value FWLD and the second correction value CD2 are calculated, the basic warmup increase correction value FWL for the case where the two-time direct injection mode is selected has been determined. At the time point when the third reference value FWLD and the third correction value CD3 are calculated, the basic warmup increase correction value FWL for the case where three-time direct injection mode is selected has been determined. In this way, the second preliminary calculating section 39 not only calculates the basic warmup increase correction value FWL for the single direct injection mode, but also substantially calculates the respective basic warmup increase correction values FWL for the port injection mode, the two-time direct injection mode, and the three-time direct injection mode.

Figure 6:
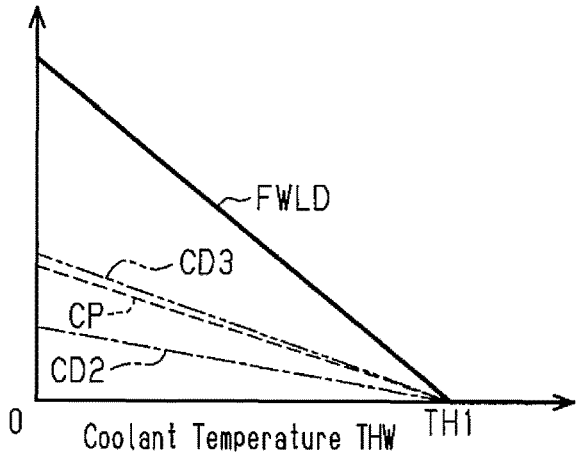
FIG. 6 is a graph showing the relationship of a coolant temperature with a third reference value, a first correction value, a second correction value, and a third correction value, which are calculated by a second preliminary calculating section provided in the fuel injection control device.

FIG. 6 shows the relationship between the coolant temperature THW and the third reference value FWLD, the first correction value CP, the second correction value CD2, and the third correction value CD3 in the calculation maps M4 to 7. The third reference value FWLD, the first correction value CP, the second correction value CD2, and the third correction value CD3 each attenuate with increase in the coolant temperature THW while the coolant temperature THW is within a range below the specified temperature TH1, and all the above values are kept 0 after a time point when the coolant temperature THW reaches a specified temperature TH1. The basic injection amount QBSE is calculated as a value obtained by predicting a vaporization failure rate at the time of completion of warmup of the internal combustion engine 10. The temperature TH1 is equal to the coolant temperature THW when the vaporization failure rate in the single direct injection mode is equal to the vaporization failure rate predicted in the calculation of the basic injection amount QBSE.

Based on the result calculated by the second preliminary calculating section 39 and of the injection mode MODE determined and the port injection ratio KPI calculated by the injection mode determining section 31, the basic warmup increase determining section 41 calculates the basic warmup increase correction value FWL to be outputted to the required injection amount determining section 35. After the injection mode determining section 31 determines the injection mode MODE, the basic warmup increase determining section 41 executes, as a latest NE interruption process, calculation of the basic warmup increase correction value FWL.

Figure 7:
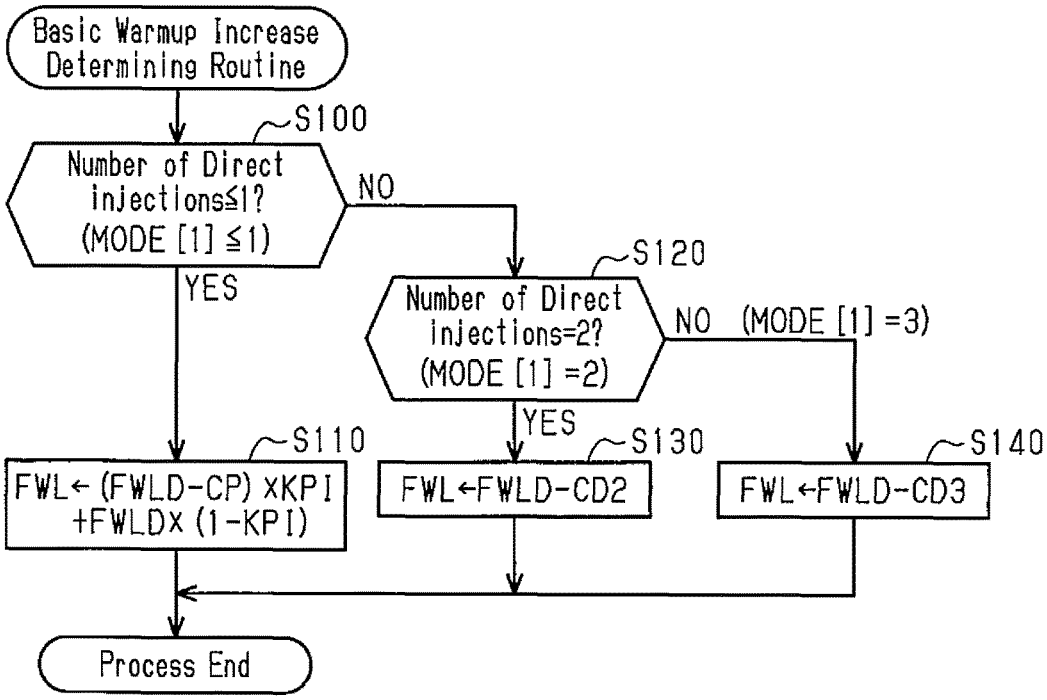
FIG. 7 is a flowchart of a basic warmup increase determining routine to be executed by a basic warmup increase determining section provided in the fuel injection control device.

FIG. 7 shows a flowchart of a basic warmup increase determining routine to be executed by the basic warmup increase determining section 41 in order to calculate the basic warmup increase correction value FWL.

When this routine is started, whether or not the number of direct injections indicated by the value of the second element MODE [1] in the injection mode MODE is 1 or less, is first determined at step S100. That is, which of the port injection mode, the distributed injection mode, and the single direct injection mode is determined as the injection mode MODE by the injection mode determining section 31 is determined (see Table 1).

When the number of direct injections is 1 or less (YES), the process proceeds to step S110. At step S110, the basic warmup increase correction value FWL is calculated based on the third reference value FWLD and the first correction value CP calculated by the second preliminary calculating section 39 and of the port injection ratio KPI calculated by the injection mode determining section 31 such that the relationship represented by the expression below is satisfied. Thereafter, the current routine process is ended.

$$FWL \leftarrow (FWLD-CP) \times KPI + FWLD \times (1-KPI) \quad \text{[Expression 3]}$$

Figure 8:
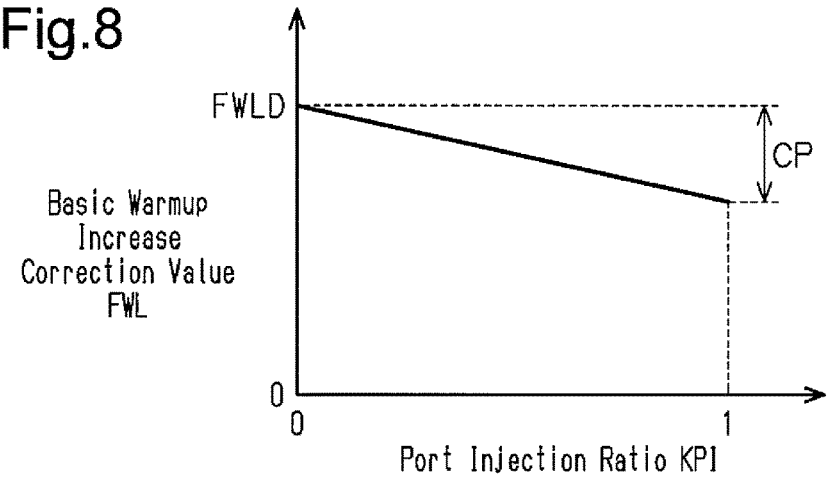
FIG. 8 is a graph showing the relationship between the port injection ratio and a basic warmup increase correction value for a distributed injection mode.

FIG. 8 shows the relationship between the port injection ratio KPI and the calculated value of the basic warmup increase correction value FWL in this case. When the number of direct injections is 1 or less and the port injection ratio KPI is 0, the injection mode MODE is the single direct injection mode. The basic warmup increase correction value FWL in this case is equal to the third reference value FWLD calculated by the second preliminary calculating section 39. In contrast, when the port injection ratio KPI is 1, that is, when the injection mode MODE is the port injection mode, the difference obtained by subtracting the first correction value CP from the third reference value FWLD (FWLD−CP) is calculated as the basic warmup increase correction value FWL. When the port injection ratio KPI is a value between 0 to 1, that is, when the injection mode MODE is the distributed injection mode, the basic warmup increase correction value FWL changes relative to the port injection ratio KPI in the following manner. That is, when the port injection ratio KPI changes from 1 to 0, the basic warmup increase correction value FWL in this case changes from the value (FWLD−CP) for the port injection mode to the value (FWLD) for the single direct injection mode.

When the number of direct injections is determined to be greater than 1 at step S100 (NO), whether or not the number of direct injections is 2, that is, whether or not the injection mode MODE determined by the injection mode determining section 31 is the two-time direct injection mode is determined at step S120. When the number of direct injections is determined to be 2 (YES), the process proceeds to step S130. At step S130, the difference obtained by subtracting the second correction value CD2 calculated by the second preliminary calculating section 39 from the third reference value FWLD also calculated by the second preliminary calculating section 39 (FWLD−CD2) is calculated as the basic warmup increase correction value FWL. Thereafter, the current routine process is ended.

On the other hand, when the number of direct injections is determined to be not 2 (NO) at step S120, that is, the injection mode MODE determined by the injection mode determining section 31 is the three-time direct injection mode, the process proceeds to step S140. At step S140, the difference obtained by subtracting the third correction value CD3 calculated by the second preliminary calculating section 39 from the third reference value FWLD also calculated by the second preliminary calculating section 39 (FWLD−CD3) is calculated as the basic warmup increase correction value FWL. Thereafter, the current routine process is ended.

Figure 9:
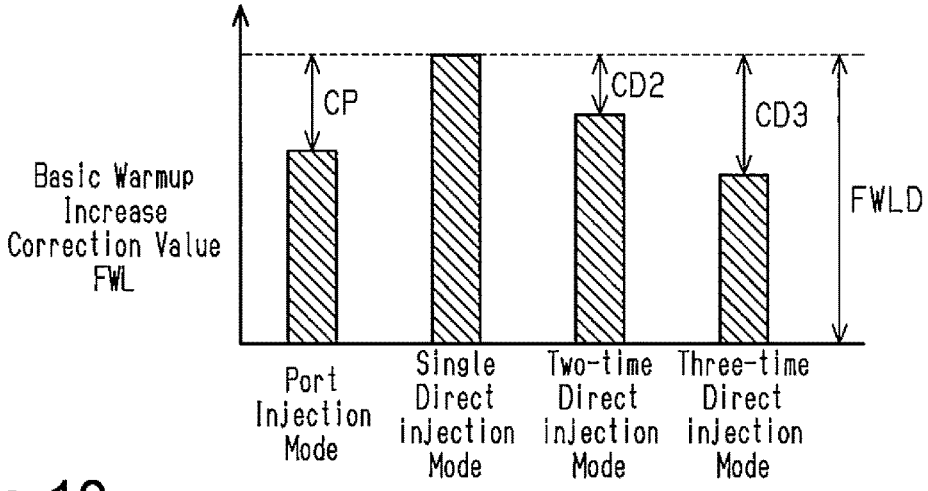
FIG. 9 is a graph showing comparison of calculated values of the basic warmup increase correction value for a port injection mode, a single direct injection mode, a two-time direct injection mode, and a three-time direct injection mode.

FIG. 9 shows calculated values of the basic warmup increase correction value FWL for the port injection mode, the single direct injection mode, the two-time direct injection mode, and the three-time direct injection mode, which are calculated at the same coolant temperature THW.

During the cold startup of the internal combustion engine 10, the temperature in the combustion chamber 16 is low and fuel is less likely to vaporize, as described above. In the port injection mode, fuel spray is stirred by air flow flowing from the intake port 17 into the combustion chamber 16. Accordingly, the vaporization failure rate is lower than that in the single direct injection mode. Thus, the basic warmup increase correction value FWL in the port injection mode is calculated as a value less than that in the single direct injection mode.

In the two-time direct injection mode, fuel spray is distributed in the combustion chamber 16 since fuel is divided and injected two times at a time interval. Accordingly, the vaporization failure rate in the two-time direct injection mode is lower than that in the single direct injection mode. Thus, the basic warmup increase correction value FWL for the two-time direct injection mode is calculated to be a value less than that for the single direct injection mode. Moreover, in the three-time direct injection mode, distribution of fuel spray in the combustion chamber 16 is further facilitated. Accordingly, the basic warmup increase correction value FWL for the three-time direct injection mode is calculated to be a value still less than that for the two-time direct injection mode.

Next, a description is given of calculation of the wall-wetting correction value FWET to be executed by the wall-wetting correcting section 34. The wall-wetting correcting section 34 executes, as a latest NE interruption process, calculation of the wall-wetting correction value FWET after the injection mode determining section 31 determines the injection mode MODE.

As described above, when the multiple direct injection mode is selected, steady decrease correction is executed. Thus, when the injection mode MODE is switched to the multiple direct injection mode from any one of injection modes (hereinafter, referred to as non-multiple injection modes) other than the multiple direct injection mode, that is, any one of the port injection mode, the distributed injection mode, and the single direct injection mode, the steady decrease correction is started. Accordingly, the fuel injection amount is decreased. In contrast, when the injection mode MODE is switched from the multiple direct injection mode to a non-multiple injection mode, the steady decrease correction is canceled. Accordingly, the fuel injection amount is increased.

Meanwhile, the amount of new fuel that adheres to the wall surfaces of the intake port 17 and the cylinder 12 and the amount of fuel volatilized from the wall surfaces are in equilibrium during stationary operation of the internal combustion engine 10. When the injection mode MODE is switched from a non-multiple injection mode to the multiple direct injection mode, the amount of new fuel that adheres to the wall surfaces is decreased by the decrease in the fuel injection amount. However, immediately after such switching of the injection mode MODE, an amount of fuel corresponding to the fuel injection amount before start of the steady decrease correction is deposited on the wall surfaces. Thus, in a certain time period immediately after switching of the injection mode MODE from a non-multiple injection mode to the multiple direct injection mode, the amount of fuel volatilized from the wall surfaces is kept unchanged from that before the switching whereas the amount of new fuel (the amount of new adhesion) that adheres to the wall surfaces is smaller than that before the switching. The amount of fuel for combustion in the combustion chamber 16 in this case is larger than the amount of injected fuel by the decrease in the amount of new adhesion.

In contrast, in a certain time period immediately after switching of the injection mode MODE from the multiple direct injection mode to a non-multiple injection mode, the amount of volatilized fuel from the wall surfaces is unchanged from that before the switching whereas the amount of new adhesion of fuel is larger than that before the switching. The amount of fuel for combustion in the combustion chamber 16 in this case is smaller than the amount of injected fuel by the increase in the amount of new adhesion.

The wall-wetting correction value FWET is a correction value for correcting a fuel injection amount corresponding to the difference between the amount of volatilized fuel and the amount of new adhesion generated immediately after switching of the injection mode MODE between the multiple direct injection mode and a non-multiple injection mode.

Figure 10:
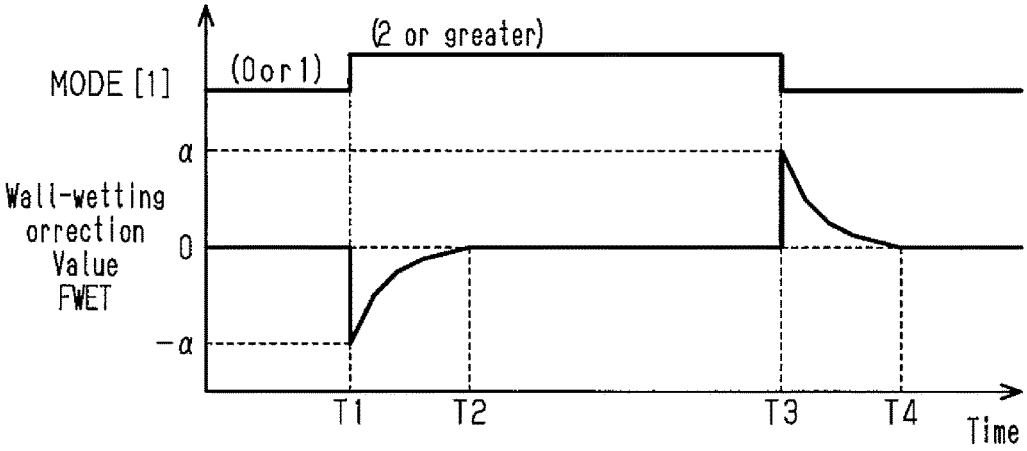
FIG. 10 is a time chart showing the movement of calculated values of a wall-wetting calculation value calculated by a wall-wetting correcting section provided in the fuel injection control device.

As shown in FIG. 10, when the injection mode MODE is switched to the multiple injection mode from any one of the other injection modes, the wall-wetting correcting section 34 sets the wall-wetting correction value FWET to $-\alpha$ (time T1). The value $\alpha$ is a constant and the value of $\alpha$ is set in advance so as to correspond to the difference between the amount of volatilized fuel and the amount of new adhesion generated immediately after switching of the injection mode MODE between the multiple injection mode and a non-multiple injection mode. Thereafter, the wall-wetting correcting section 34 attenuates the wall-wetting correction value FWET by a specified rate according to an increment of the number of times of combustion carried out after switching of the injection mode MODE. When the absolute value of the wall-wetting correction value FWET is decreased to be lower than a specified value, the wall-wetting correction value FWET is set to 0 (time T2).

On the other hand, when the injection mode MODE is switched from the multiple injection mode to any one of the other injection modes, the wall-wetting correcting section 34 sets the wall-wetting correction value FWET to a (time T3). Thereafter, the wall-wetting correcting section 34 attenuates the wall-wetting correction value FWET, by a specified rate, according to an increment of the number of times of combustion carried out after switching of the injection mode MODE. When the absolute value of the wall-wetting correction value FWET is decreased to be lower than a specified value, the wall-wetting correction value FWET is set to 0 (time T4).

The present embodiment achieves the following advantages.

(1) In the fuel injection control device 30, the cold-time fuel increasing section 33 calculates the increase-after-startup correction value FASE and the basic warmup increase correction value FWL of a required injection amount such that the increase-after-startup correction value FASE is calculated as a value that is attenuated with an increment of the number of times of combustion carried out after startup of the internal combustion engine 10, and the basic warmup increase correction value FWL is calculated as a value that is attenuated with an increase in the coolant temperature THW in the internal combustion engine 10. The cold-time fuel increasing section 33 calculates the increase-after-startup correction value FASE such that the increase-after-startup correction value FASE for the case where the port injection mode is selected is greater than the increase-after-startup correction value FASE for the case where the single direct injection mode is selected.

The increase-after-startup correction value FASE, which is calculated as a value that is attenuated with an increment of the number of times of combustion after startup, is a correction value for performing correction to increase the fuel injection amount by the amount of adhesion to the wall surfaces that increases immediately after the start of cold startup. The amount of fuel adhesion to the wall surfaces immediately after the start of cold startup is larger in the port injection mode than that in the single direct injection mode. Regarding this point, in the present embodiment, the increase-after-startup correction value FASE for the port injection mode is calculated to be a value greater than that in the single direct injection mode so as to reflect this point. Therefore, correction to increase the fuel injection amount by the amount of adhesion to the wall surfaces during the cold startup can be appropriately performed both in the port injection mode and the single direct injection mode.

(2) The cold-time fuel increasing section 33 calculates the basic warmup increase correction value FWL such that the basic warmup increase correction value FWL for the case where the single direct injection mode is selected is greater than the basic warmup increase correction value FWL for the case where the port injection mode is selected. The basic warmup increase correction value FWL, which is calculated as a value that is attenuated with an increase in the coolant temperature THW, is an increase correction value for increasing the fuel injection amount by an amount corresponding to a failure in vaporization, which remarkably occurs during the cold startup. In the single direct injection mode, a failure in vaporization during the cold startup more remarkably occurs compared to that in the port injection mode. Regarding this point, in the present embodiment, the basic warmup increase correction value FWL in the single direct injection mode is calculated to be a value greater than that in the port injection mode so as to reflect this point. Therefore, correction to increase the fuel injection amount by an amount corresponding to a failure in vaporization during the cold startup can be appropriately performed both in the port injection mode and the single direct injection mode.

(3) When the distributed injection mode is selected, the cold-time fuel increasing section 33 calculates the increase-after-startup correction value FASE and the basic warmup increase correction value FWL such that when the port injection ratio KPI is changed from 1 to 0, the values FASE, FWL are changed from the values for the port injection mode to the values for the single direct injection mode. In this case, the increase-after-startup correction value FASE and the basic warmup increase correction value FWL for the distributed injection mode can be set to respective appropriate values corresponding to the port injection ratio KPI.

(4) When the multiple direct injection mode is selected, the cold-time fuel increasing section 33 calculates the basic warmup increase correction value FWL such that the value FWL is less than that for the single direct injection mode and is a value that is decreased with an increment of the number of divided fuel injections. In the multiple direct injection mode, a failure in fuel vaporization during the cold startup is alleviated compared to that in the single direct injection mode. Further, a failure in fuel vaporization is still further alleviated as the number of divided fuel injections in the multiple injection mode is greater. Thus, the basic warmup increase correction value FWL for the multiple injection mode can be calculated to be a value that reflects alleviation of a failure in vaporization due to divided fuel injection.

(5) When the multiple direct injection mode is selected as the injection mode, the efficiency of generating torque in the internal combustion engine is high because combustion therein is improved. For this reason, when the multiple direct injection mode is selected as the injection mode, correction to decrease the specified amount of the required injection amount is performed to suppress an abrupt change in the torque with the other injection modes. At the time of switching of the injection mode MODE, starting and canceling of steady decrease correction generates an abrupt change in the fuel injection amount so that the balance between fuel adhesion and fuel volatilization on the wall surfaces of the piston 11 and the cylinder 12 is temporarily lost. Regarding this point, in the present embodiment, the wall-wetting correcting section 34 performs correction to increase the required injection amount QINJ immediately after switching of the injection mode MODE from the multiple direct injection mode in which steady decrease correction is performed to a non-multiple injection mode. Also, the wall-wetting correcting section 34 performs correction to decrease the required injection amount QINJ immediately after switching of the injection mode MODE from a non-multiple injection mode to the multiple direct injection mode. By means of the wall-wetting correcting section 34, the fuel injection amount can be appropriately corrected to address the aforementioned lost balance.

(6) At a time prior to determination of injection mode MODE, the cold-time fuel increasing section 33 calculates the increase-after-startup correction value FASE and the basic warmup increase correction value FWL for each of the port injection mode and the single direct injection mode. After determination of the injection mode MODE, the cold-time fuel increasing section 33 sets the calculated values of the increase-after-startup correction value FASE and the basic warmup increase correction value FWL to values for the determined injection mode MODE from among the calculated values. Further, at a time prior to determination of the injection mode MODE, the cold-time fuel increasing section 33 calculates in advance the increase-after-startup correction value FASE and the basic warmup increase correction value FWL also for each of the two-time direct injection mode and the three-time direct injection mode. Moreover, in the distributed injection mode, after the distributed injection mode is determined as the injection mode MODE, the cold-time fuel increasing section 33 calculates the increase-after-startup correction value FASE and the basic warmup increase correction value FWL based on the values for each of the port injection mode and the single direct injection mode and the port injection ratio KPI. Consequently, appropriate increase correction corresponding to the injection mode MODE, which is to be actually executed, can be surely executed. In addition, since some or all of the values are calculated prior to determination of the injection mode MODE, an amount of calculation that is executed after determination of the injection mode MODE can be accordingly reduced. Therefore, calculation of the increase-after-startup correction value FASE and the basic warmup increase correction value FWL can be easily completed within a limited time period from determination of the injection mode MODE to start of injection.

The above-described embodiment may be modified as follows.

In the above embodiment, the time at which the first preliminary calculating section 38 calculates the first reference value FASEP and the second reference value EASED is different from the time at which the increase-after-startup determining section 40 calculates the increase-after-startup correction value FASE. However, these calculation times may be the same. In this case, the first preliminary calculating section 38 also executes calculation after the injection mode MODE for which calculation is to be executed is determined. Thus, the first preliminary calculating section 38 needs to calculate only one of the first reference value FASEP and the second reference value FASED.

In the above embodiment, the time at which the second preliminary calculating section 39 calculates the third reference value FWLD, the first correction value CP, the second correction value CD2, and the third correction value CD3 is different from the time at which the basic warmup increase determining section 41 calculates the basic warmup increase correction value FWL. However, these calculation times may be the same. In this case, the second preliminary calculating section 39 also executes calculation after the injection mode MODE for which calculation is to be executed is determined. Thus, the second preliminary calculating section 39 needs to calculate the third reference value FWLD in any case, but may calculate the first correction value CP, the second correction value CD2, and the third correction value CD3 only when needed.

The correction using the wall-wetting correction value FWET may be omitted and the wall-wetting correcting section 34 may be eliminated.

From among the injection modes MODE to be switched according to the operation state of the internal combustion engine 10, the multiple direct injection mode may be omitted. In this case, the second preliminary calculating section 39 does not need to calculate the second correction value CD2 or the third correction value CD3. Also, the wall-wetting correcting section 34 naturally does not need to calculate the wall-wetting correction value FWET.

From among the injection modes MODE to be switched according to the operation state of the internal combustion engine 10, the distributed direct injection mode may be omitted. In this case, the injection mode determining section 31 does not need to calculate the port injection ratio KPI. Further, in this case, the process of calculating the increase-after-startup correction value FASE executed by the increase-after-startup determining section 40 is a process of selecting, as a value to be set as the increase-after-startup correction value FASE, the first reference value FASEP or the second reference value EASED according to the injection mode MODE. Moreover, in this case, the process of calculating the basic warmup increase correction value FWL at step S110 of the basic warmup increase determining routine in FIG. 7 is a process of selecting, as a value to be set as the basic warmup increase correction value FWL, the third reference value FWLD or the difference obtained by subtracting the first correction value CP from the third reference value FWLD according to the injection mode MODE.

In the above embodiment, the cold-time fuel increasing section 33 differentiates both the increase-after-startup correction value FASE and the basic warmup increase correction value FWL for the case where the port injection mode is selected from those for the case where the single direct injection mode is selected. That is, the cold-time fuel increasing section 33 executes both (A) calculation of the increase-after-startup correction value FASE such that the increase-after-startup correction value FASE for the case where the port injection mode is selected is greater than the increase-after-startup correction value FASE for the case where the single direct injection mode is selected, and (B) calculation of the basic warmup increase correction value FWL such that the basic warmup increase correction value FWL for the case where the single direct injection mode is selected is greater than the basic warmup increase correction value FWL for the case where the port injection mode is selected. The cold-time fuel increasing section 33 may execute only one of (A) and (B).

In the above embodiment, the injection mode is expressed by use of the array (MODE) formed of two elements indicating the number of port injections and the number of direct injections. However, the injection mode may be expressed by other methods.

The invention claimed is:

1. A fuel injection control device which is applied to an internal combustion engine, the engine including a port injection valve, which injects fuel into an intake port, and a direct injection valve, which injects fuel into a combustion chamber, wherein the fuel injection control device is configured to perform switching, according to an operation state of the internal combustion engine, between a port injection mode, in which a required injection amount of fuel is injected by the port injection valve, and a single direct injection mode, in which a required injection amount of fuel is injected in a single fuel injection carried out by the direct injection valve, the fuel injection control device comprises a cold-time fuel increasing section, which calculates an increase-after-startup correction value and a basic warmup increase correction value for the required injection amount, the cold-time fuel increasing section calculates the increase-after-startup correction value, which attenuates with an increment of the number of times of combustion carried out after startup of the internal combustion engine, and calculates the basic warmup increase correction value, which attenuates with an increase in a temperature of coolant in the internal combustion engine, and the cold-time fuel increasing section executes (A) calculation of the increase-after-startup correction value such that the increase-after-startup correction value when the port injection mode is selected is greater than the increase-after-startup correction value when the single direct injection mode is selected, and/or (B) calculation of the basic warmup increase correction value such that the basic warmup increase correction value when the single direct injection mode is selected is greater than the basic warmup increase correction value when the port injection mode is selected.

2. The fuel injection control device according to claim 1, comprising a distributed injection mode, in which the fuel injection control device divides the required injection amount into an injection amount for the port injection valve and an injection amount for the direct injection valve, and causes both the port injection valve and the direct injection valve to inject fuel, wherein a ratio of the injection amount of the port injection valve to the required injection amount is defined as a port injection ratio, and if the port injection ratio is changed from 1 to 0 when the cold-time fuel increasing section executes the (A) and the distributed injection mode is selected, the cold-time fuel increasing section calculates the increase-after-startup correction value such that the increase-after-startup correction value for the port injection mode is changed to the increase-after-startup correction value for the single direct injection mode.

3. The fuel injection control device according to claim 1, comprising a distributed injection mode, in which the fuel injection control device divides the required injection amount into an injection amount for the port injection valve and an injection amount for the direct injection valve, and causes both the port injection valve and the direct injection valve to inject fuel, wherein a ratio of the injection amount of the port injection valve to the required injection amount is defined as a port injection ratio, and if the port injection ratio is changed from 1 to 0 when the cold-time fuel increasing section executes the (B) and the distributed injection mode is selected, the cold-time fuel increasing section calculates the basic warmup increase correction value such that the basic warmup increase correction value for the port injection mode is changed to the basic warmup increase correction value for the single direct injection mode.

4. The fuel injection control device according to claim 1, comprising a multiple direct injection mode, in which the fuel injection control device divides and injects the required injection amount of fuel in multiple injections from the direct injection valve, wherein, when the cold-time fuel increasing section executes the (B) and the multiple direct injection mode is selected, the cold-time fuel increasing section calculates the basic warmup increase correction value such that the calculated basic warmup increase correction value is less than the basic warmup increase correction value for the single direct injection mode and that the calculated basic warmup increase correction value decreases with an increment of the number of times of dividing the fuel injection.

5. The fuel injection control device according to claim 4, wherein the fuel injection control device performs correction to decrease a specified amount of the required injection amount when the multiple direct injection mode is selected, and the fuel injection control device comprises a wall-wetting correcting section, which performs correction to decrease the required injection amount immediately after switching of the injection mode from either the single direct injection mode or the port injection mode to the multiple direct injection mode, and that performs correction to increase the required injection amount immediately after switching of the injection mode from the multiple direct injection mode to either the single direct injection mode or the port injection mode.

6. The fuel injection control device according to claim 1, wherein the cold-time fuel increasing section executes the (A), calculates both the increase-after-startup correction value for the port injection mode and the increase-after-startup correction value for the single direct injection mode before determination of the injection mode, and sets a calculated value of the increase-after-startup correction value to the increase-after-startup correction value for the determined injection mode of the two calculated values after the determination of the injection mode.

7. The fuel injection control device according to claim 1, wherein the cold-time fuel increasing section executes the (B), calculates both the basic warmup increase correction value for the port injection mode and the basic warmup increase correction value for the single direct injection mode before determination of the injection mode, and sets a calculated value of the basic warmup increase correction value to the basic warmup increase correction value for the determined injection mode of the two calculated values after the determination of the injection mode.

* * * * *